United States Patent [19]

Thettu

[11] 4,018,555

[45] Apr. 19, 1977

[54] CLEANING APPARATUS FOR ROLL FUSER

[75] Inventor: Raghulinga R. Thettu, Webster, N.Y.

[73] Assignee: Xerox Corporation, Stamford, Conn.

[22] Filed: Sept. 24, 1975

[21] Appl. No.: 616,454

[52] U.S. Cl. ..... 432/75; 15/256.52; 118/60; 118/70; 219/216

[51] Int. Cl.[2] ..... F27D 23/00

[58] Field of Search ..... 219/216, 469; 355/3 FU, 355/9, 15; 15/256.51, 256.52, 1.5 R; 100/93 RP; 432/60, 75, 228; 118/60, 70, 104, 204, 637

[56] References Cited

UNITED STATES PATENTS

| | | | |
|---|---|---|---|
| 3,656,200 | 4/1972 | Riley, Jr. | 15/256.52 X |
| 3,861,861 | 1/1975 | Thettu | 432/59 X |
| 3,884,572 | 5/1975 | Bacon | 15/1.5 R X |

*Primary Examiner*—C. L. Albritton

[57] ABSTRACT

A contact fuser assembly for use in electrostatic reproducing apparatus, said assembly including a heated fuser roll structure cooperating with a backup roll to form a nip through which copy sheets or substrate material having toner images thereon move with the toner images contacting the heated fuser roll structure. The fuser assembly is characterized by the provision of a cleaning arrangement comprising a roll having a tacky surface which is adapted to contact the fuser roll structure to thereby remove toner and other contaminants therefrom with subsequent embedding of the contaminants in the tacky surface. The cleaning arrangement is further characterized by the provision of means for maintaining the effectiveness of the cleaning arrangement.

6 Claims, 2 Drawing Figures

CLEANING APPARATUS FOR ROLL FUSER

BACKGROUND OF THE INVENTION

This invention relates generally to xerographic copying apparatus and, more particularly, to a contact fusing system and cleaning mechanism therefor for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitutes plain paper. Thereafter, as the toner material cools, solidification of the toner material occurs causing the toner material to be firmly bonded to the support member. In both the xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the heated roll to thereby effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner would liquify and cause a splitting action in the molten toner to thereby result in hot offset. Splitting occurs when the cohesive forces holding the viscous toner mass together are less than the adhesive forces tending to offset it to a contacting surface such as a fuser roll.

However, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

Various arrangements for minimizing the problems attendant the foregoing, particularly that which is commonly referred to as "offsetting" are known in the art. Notwithstanding such arrangements, it is still necessary to provide means for cleaning toner and other contaminants from the roll members, particularly, the fuser roll.

One means of cleaning toner and other contaminants from a fuser roll structure is by the provision of a cleaning member having a surface which is tacky at the operating temperature of the fuser roll. Such tackiness is usually provided by having a coating of polymer material comprising the outer layer or coating of the cleaning member. While such a cleaning member has been found to be acceptable it has also been discovered that during certain modes of operation of the copying apparatus the cleaning efficiency of such a member can be adversely affected.

Accordingly, the primary object of this invention is to provide a new and improved contact fuser system for fixing toner images to substrates.

A more particular object of this invention is to provide, in a contact fuser system, means for cleaning the heated fuser member from the contact fuser assembly .

Another object of this invention is to provide, in a contact fusing apparatus, structure for cleaning contaminants from a heated member of the fusing apparatus wherein the cleaning structure has a tacky surface in which the contaminants become embedded.

Still another object of this invention is to provide, in a fuser apparatus, apparatus and a method for cleaning a heated fuser member wherein the cleaning member is provided with a tacky surface capable of having contaminants removed from the fuser member embedded therein and wherein a mixing member is provided for increasing the toner embedding rate or efficiency of the tacky surface.

BRIEF SUMMARY OF THE INVENTION

Briefly, the above-cited objects are accomplished by the provision of a roll fuser apparatus comprising a heated fuser roll structure cooperating with a resilient backup roll member to form a nip through which copy sheets having toner images thereon move with the toner images contacting the heated fuser roll structure.

A cleaning roll member having a tacky surface is supported for contact with the fuser roll structure in order to remove contaminants such as toner and paper fiber therefrom.

The tacky surface of the cleaning roll may be provided by incompletely curing a silicone rubber layer forming the outer surface of the cleaning roll or a roll structure can be provided with a sleeve containing polymer material capable of becoming tacky at the operating temperature of the fuser roll structure.

During operation of such a cleaning structure contaminants offset or otherwise finding their way to the surface of the fuser roll structure or member being cleaned become embedded in the tacky polymer surface of the cleaning roll. It has been discovered that if the collecting of the contaminants from the fuser roll structure occurs at a greater rate than the contaminants can become embedded in the tacky polymer the efficiency of the system diminishes. Accordingly, pursuant to the objects of the present invention, a combination mixing and adhesive supply roll (i. e. a roll having a tacky polymer surface) is provided which serves the purpose of removing contaminants from the cleaning rolls that have not become embedded in the tacky polymer surface. Normally the contaminants removed from the cleaning roll by the combination mixing and adhesive supply roll are those which have been offset to the cleaning roll and are held thereto by other contaminants rather than the tacky polymer. Random breaking of the contamination layer as well as the adhesive layer take place between the cleaning roll and the combination mixing and adhesive supply roll. Tacky polymer adhesive thus undergoes continuous shearing between the cleaning and the supply roll while transferring back and forth between the two surfaces thereof. In this manner, mixing of the contaminants in a tacky polymer takes place.

During the mixing operation, the mixing and adhesive supply roll develops ridges corresponding to mixing areas. It is desirable to smooth such ridges otherwise during the standby mode of operation the ridges become hard with sharp edges which produce non-uniform contact with the cleaning roll resulting in cutting of the surface thereof. To obviate the foregoing, a combination sizing and smoothing roll is utilized to contact the mixing and supply roll. The sizing roll comprises an elastomer covered roll coated with identical coating material as that of the fuser roll structure which in the preferred embodiment of the invention comprises silicone rubber. Such a material is relatively immune to offset of tacky toner polymers thereto because of its adhesive properties.

Other objects and advantages of the present invention will become apparent when read in conjunction with the accompanying drawings.

DETAILED DESCRIPTION OF THE PREFERRED EMBODIMENTS

Since the xerographic reproducing process is well known, a detailed description thereof is omitted. For those who would consider a description of a xerographic process necessary for a complete understanding of the present invention, reference may be had to U.S. Pat. Nos. 3,718,116, 3,745,972 and 3,861,860 which patents are incorporated herein by reference.

Figure 1:
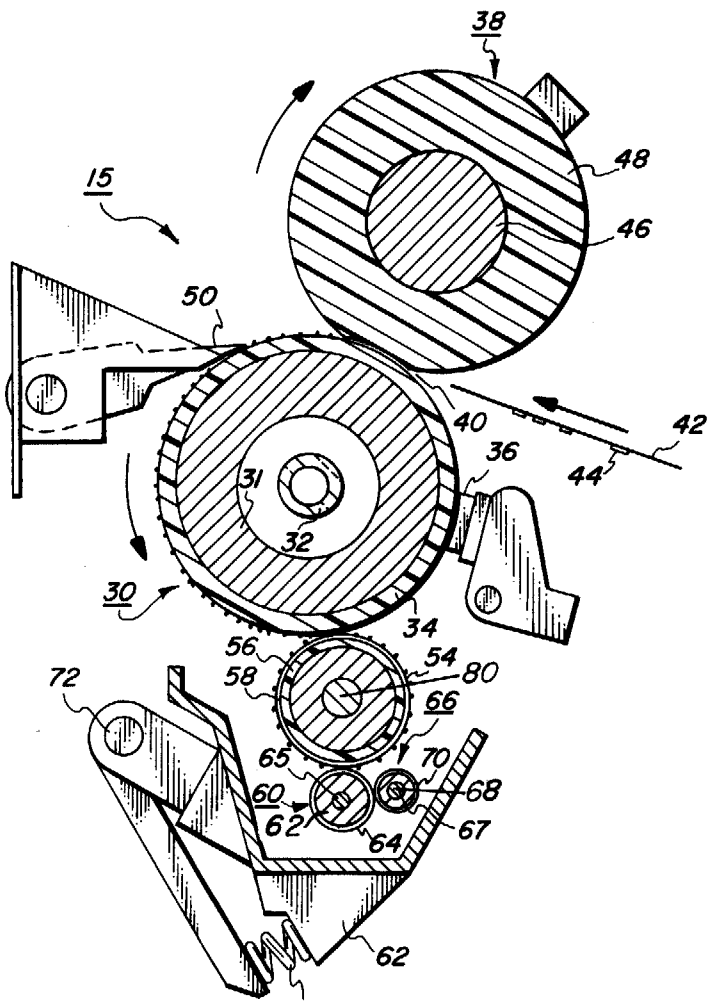
FIG. 1 is a side elevational view schematically representing a fuser apparatus incorporating the novel heating system.

As shown in FIG. 1, the present invention comprises a fuser roll assembly 15 including a heated roll structure 30 including a hollow cylinder or core 31 having a suitable heating element 32 disposed in the hollow portion thereof and which is coextensive with the longitudinal axis of said cylinder or core. The core 31 has provided on the outer surface thereof a layer of silicone rubber 34 or other suitable material which has adhesive characteristics, therefore, tendency to release toner type contaminants therefrom. The heating element 32 may comprise a suitable type heater for elevating the surface of the silicone rubber layer to operational temperatures, therefore, temperatures on the order of 250° to 450° F. For example, the heating element may comprise a quartz lamp. The cylinder or core 31 is fabricated from any thermally conductive material, for example, steel, aluminum, or alloys thereof. The resulting structure has an outside diameter on the order of 1.5 to 3.0 inches and a length on the order of 10 to 15 inches. Power requirements for the foregoing are 500–2500 watts, peak power with an average power 300–2000 watts and 75–250 watts for standby.

The surface temperature of the fuser roll structure is controlled by contacting the surface thereof with a thermistor probe 36 in a manner described in U.S. Pat. No. 3,327,096, issued in 1967 to Bernous and incorporated herein by reference. To this end, the end of the roll contacted by the thermistor probe 36 may be specifically designed to accommodate such control of the operating temperature. In other words, means may be provided to reduce friction between the probe 36 and the surface of the fuser roll structure. One method of accomplishing the foregoing would be to manufacture the fuser roll structure 30 such that the end thereof contacted by the probe 36 is devoid of silicone rubber material whereby the probe contacts the core and the set point of the thermistor is adjusted accordingly.

The fuser assembly 15 further comprises a backup roll structure 38 which cooperates with the fuser roll structure to form a nip 40 through which copy paper or substrate material 42 passes such that toner images 44 thereon contact the surface of the fuser roll structure 30. The backup roll structure may comprise any suitable construction for example, a steel cylinder, but preferably comprises a rigid steel core 46 having a Viton elastomer surface or layer 48 which as can be observed has a relatively large thickness in order to provide a soft member which can be indented by the fuser roll structure 30 in order to form the nip 40.

After the copy sheet or substrate material 42 passes through the nip 40 it tends to stick or adhere to the surface of the fuser roll structure 30. Accordingly, stripper finger structure 50 is provided for stripping the copy sheet or substrate material from the surface of the fuser roll structure 30 so that the copy sheets can continue on their intended path of movement toward the exit of the copier apparatus.

As noted hereinbefore, as the copy sheets 42 pass through the nip 40 in contact with the surface of the fuser roll structure 30 and the backup roll structure 38 contaminants are offset onto the surface of the fuser roll structure 30. Because the surface of the fuser roll structure 30 comprises the aforementioned silicone rubber which constitutes an adhesive material, the contaminants can be readily removed from the fuser roll structure 30. Also noted above was the fact that tacky surfaced cleaning rolls such as cleaning roll structure 54 shown in its operative position (i.e. engaged with the fuser roll structure 30) for removing contaminants such as toner and paper fiber from fuser roll structures are well known. In its inoperative position the roll structure 54 is moved out of engagement from the fuser roll structure. One form of such a cleaning roll structure comprises a sleeve carried by a core member which is, in turn, rotatingly supported by means of a shaft, the ends of which are supported by end plates (not shown) of a support mechanism 62. A cleaning structure of this type is disclosed in U.S. Pat. No. 3,861,860 issued in the name of Thettu and incorporated herein by reference. As described in the foregoing patent, the sleeve is provided with a polymer material which is tacky at the operating temperature of the fuser roll structure. The polymer material preferably comprises a material selected from the group of aliphatic, aromatic or mixtures of aliphatic, aromatic polyesters which have a melting or softening point ranging from about 120° to about 275° C. Consequently, the polymer provides an effective mechanism for removing the contaminants 52 from the surface of the fuser roll structure 30.

The cleaning roll structure 54 comprises a sleeve 56 which is provided with a polymer material which is tacky at the operating temperature of the fuser roll structure. The polymer material forms a layer 58 on the outer surface of the roll structure 54. A heater 80 is provided internally of said cleaning roll structure for softening the polymer material.

In operation, the toner and other contaminants removed from the fuser roll structure become embedded in the outer layer 58 and during certain modes of operation (i.e. short copy runs) the contaminants are worked into the layer of polymer material and are mixed adequately therewith. However, during certain other modes of operation (i.e. longer copy runs) a much greater quantity of contaminants must be handled, and therefore, there isn't sufficient time to become mixed into the polymer layer of the cleaning roll structure 54. Accordingly, a combination mixing and adhesive supply roll structure 60 is provided for obviating this condition. The mixing adhesive supply roll 60 comprise a metal core 62 covered with a tacky polymeric layer 64. By the provision of the roll structure 60 and its tacky polymer layer 64, a cross mixing of contaminants and polymer material between the cleaning roll and the roll structure 60 results which tends to obviate the condition where the toner contaminant transfer rate from fuser roll structure to the cleaning roll structure is greater than the rate at which the contaminants can become embedded in the polymer layer on the cleaning roll structure.

A roll structure 66 comprising a core 68 and an elastomeric surface or outer coating 70 is provided for smoothing irregularities on the roll structure 60 to thereby prevent damage occurring to the cleaning roll structure by sharp edges formed on the roll structure 60.

The support structure 62 is pivotably supported as indicated at 72 and can therefore be pivoted clockwise to remove the cleaning roll structure from engagement with the fuser roll structure and then in a counterclockwise direction to effect engagement therebetween. A spring 74 provides a simple bias means for maintaining proper engagement of the cleaning roll structure and the fuser roll structure. The rolls 54, 60 and 66 are sequentially engaged during operation as illustrated in the drawings.

The sequential engagement is achieved by cam mechanism which is essential for smooth operation of the system. In the engagement sequence the cleaning roll 54 contacts heated fuser roll 30 initially which is followed by supply and mixing roll 60 contacting cleaning roll 54 and finally smoothing roll 66 contacts supply and mixing roll. Individual cam and follower (not shown) pairs which may be solenoid actuated are provided for effecting engagement of the rolls 54 and 60 in the sequence described.

However, it is desirable that all of the rolls be disengaged from each other during inoperative periods. Accordingly, disengagement means (not shown) in the form of conventional cams and cam followers may be employed for such purposes in accordance with skills known in the art.

A supply of thermal energy, for example, a Cal Rod heater 65 having a capacity on the order of 25–30 watts is provided internally of the structure 60. The roll structure 66 is also provided internally thereof with a source of thermal energy 67. The sources of energy 65 and 67 assist in maintaining the tacky polymer on the roll structures 54 and 60 in a softened condition.

Optionally, the roll structures 54 and 60 are driven separately with overriding clutches to reduce the drive torque on the fuser roll member during the mixing mode.

Figure 2:
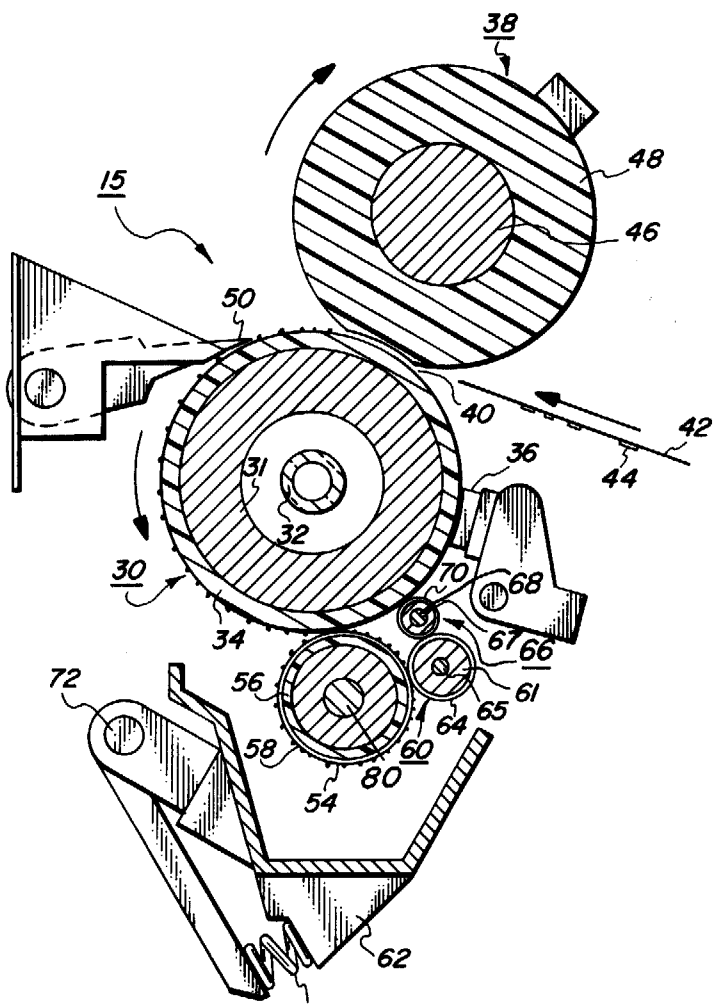
FIG. 2 is a side elevational view schematically representing a fuser apparatus incorporating a modified form of the cleaning structure disclosed in FIG. 1.

A modified form of the invention as illustrated in FIG. 2 is identical to the structure disclosed in FIG. 1 with the exception that the roll structure 66 is held in contact with the heated fuser roll structure during operation which thereby renders unnecessry the employment of an internal heat source for such roll structure.

In the modified form of the invention embodiment the engagement sequence is slightly modified by allowing the smoothing roll and cleaning roll contacting the fuser roll simultaneously or first and second respectively. The mixing and supply roll next makes contact with smoothing roll prior to contacting the cleaning roll.

While the invention has been disclosed in conjunction with the preferred embodiments of the invention, modifications thereto within the scope of the invention will become apparent to those skilled in the art and such modifications are intended to be covered by the claims appended hereto.

What is claimed is:

1. Fuser apparatus for fixing toner images to substrate material, said apparatus comprising:

a pair of nip-forming members between which said substrate material moves with said toner images contacting a heated one of said nip-forming members;

means for elevating the surface temperature of said heated member to thereby render said toner images tacky;

cleaning means for removing contaminants from the surface of said heated member;

a combination mixing and tacky material supply member supported for contact with said cleaning means to thereby effect thorough mixing of contaminants with tacky material, said tacky material comprising a polymeric material which is tacky at the operating temperature of said fuser apparatus; and a smoothing member operatively engaging said combination mixing and supply member for maintaining a substantially uniform surface on said mixing and supply member; said smoothing member comprising an adhesive surface.

2. Apparatus according to claim 1 wherein said cleaning means and said cleaning member are provided with separate means for elevating the temperature thereof for maintaining said polymeric material in a softened condition.

3. Apparatus according to claim 2 wherein said polymeric material is selected from a group consisting of aliphatic, aromtic and mixtures of aliphatic and aromtic polyesters.

4. Apparatus according to claim 3 wherein said nip-forming members comprise roll structures.

5. Apparatus according to claim 1 wherein said cleaning means is provided with a source of thermal energy for maintaining said polymeric material in a softened condition and said smoothing member engages said heated member during operation whereby its temperature is elevated for assisting and maintaining said polymeric material in a softened condition.

6. Apparatus according to claim 5 wherein said nip-forming members, said cleaning means, said combination and mixing and supply member and said smoothing member comprise elongated roll structures.

* * * * *